US005084115A

United States Patent [19]

Hadjipanayis et al.

[11] Patent Number: 5,084,115

[45] Date of Patent: Jan. 28, 1992

[54] COBALT-BASED MAGNET FREE OF RARE EARTHS

[75] Inventors: George C. Hadjipanayis, Newark, Del.; Chuan Gao, Manhattan, Kans.; Donald L. Gramlich, Belleville, Mich.

[73] Assignee: Ford Motor Company, Dearborn, Mich.

[21] Appl. No.: 408,160

[22] Filed: Sep. 14, 1989

[51] Int. Cl.[5] ..... H01F 1/04

[52] U.S. Cl. ..... 148/313; 148/311; 420/435

[58] Field of Search ..... 148/313, 311; 420/435

[56] References Cited

U.S. PATENT DOCUMENTS

| | | | |
|---|---|---|---|
| 4,081,297 | 3/1978 | Nagel et al. | 148/103 |
| 4,090,892 | 5/1978 | Klein et al. | 148/103 |
| 4,131,495 | 12/1978 | Menth et al. | 148/301 |
| 4,213,803 | 7/1980 | Yoneyama et al. | 148/102 |
| 4,369,075 | 1/1983 | Nobuo et al. | 148/102 |

OTHER PUBLICATIONS

Treseder, NACE Corrosion Engineer's Reference Book, 1980, pp. 20 and 21.

"Hard Magnetic Properties of Nd-Co-B Materials", Journal of Applied Physics, Fuerst et al., 1988, vol. 64, No. 3, p. 1332.

"Magnetic Hardening of Pr2Co14B", Journal of Applied Physics, Fuerst et al., 1988, vol. 64, No. 10, p. 5556.

"Magnetic Moment Suppression in Rapidly Solidified Co-Te-B Alloys", Ghemawat et al., Journal of Applied Physics, vol. 63, No. 8, 1988, pp. 3388-3390.

Attached Appendix sheet.

*Primary Examiner*—John P. Sheehan

*Attorney, Agent, or Firm*—Joseph W. Malleck; Roger L. May

[57] ABSTRACT

A hard magnetic alloy free of rare earths, consisting of 14-20% of a transition metal (Zr or Hf), 1-5% silicon, 0.3-5.6% boron, and the remainder essentially cobalt, the alloy having a microstructure substantially devoid of nonmagnetic phases and consisting of a high proportion of $(Co\text{-}Si)_{11}TM_2$ phase and a lesser proportion of $(Co\text{-}Si)_{23}TM_6$ phase, such phases being distributed throughout in a regular manner in a fine grain. Substitution agents of nickel or iron may be used for up to 10% of the cobalt, substitutional agents of vanadium or niobium may be used for up to 5% of the TM, and aluminum, copper, or gallium for up to 2% of the silicon. The alloy has high coercivity, high temperture stability, and excellent corrosion resistance. The alloy may be processed directly by extrusion with reduced requirements for boron and silicon.

10 Claims, 11 Drawing Sheets

Hc=5.7

HYSTERESIS LOOPS IN $Co_{76}Zr_{18}B_3Si_3$ AT DIFFERENT TEMPERATURES.

$Co_{74}Hf_{20}B_3Si_3$

COBALT-BASED MAGNET FREE OF RARE EARTHS

BACKGROUND OF THE INVENTION

1. Technical Field

This invention relates to the art of making permanent magnets, and more particularly to the art of making cobalt-based magnets.

2. Discussion of the Prior Art

The first major use of cobalt in the making of permanent magnets occurred about 1969 when used as a base in conjunction with rare earths to attain an energy product material higher than anything attained with the best ALNICO alloys for ferrite magnets. Such cobalt/rare earth magnets possessed strong anisotropism and large coercivities (see U.S. Pat. Nos. 4,081,297; 4,090,892; 4,131,495; 4,213,803; 4,369,075; and articles listed in the Appendix).

Due to the difficulty of obtaining cobalt at reasonable cost, this advancement was overshadowed by the development of stabilized iron-based rare earth magnet alloys which attained many magnetic properties equal to or greater than that of cobalt-based rare earth magnets. Optimization of such iron-based rare earth magnets has continued throughout the 1980's, including resubstitution of cobalt for iron (see Fuerst, C. D. and Herbst, J. F. (1988), "Hard Magnetic Properties of Nd—C—B Materials", *Journal of Applied Physics.* Vol. 64, No. 3, page 1332; and Fuerst, C. D., Herbst, J. F., and Pinkerton, F. E. (1988), "Magnetic Hardening of $Pr_2Co_{14}B$", *Journal of Applied Physics.* Vol. 64, No. 10, page 5556) to stabilize magnetic properties at higher temperatures, but did so with significant degradation of the properties of the rare earth system.

With changing economics of raw material supply, including an increase in the abundance of cobalt and an increase in the price of rare earths, it has recently become practical to deploy cobalt as a predominant ingredient of permanent magnets without the presence of rare earths. Applicants are unaware of any prior art that has investigated rare earth free cobalt-based permanent magnets except for an active basic research program carried out at the Massachusetts Institute of Technology, Cambridge, Mass., directed to cobalt/boron alloys as evidenced by the article "Magnetic Moment Suppression in Rapidly Solidified Co—TE—B Alloys", by A. M. Ghemawat et al, *Journal of Applied Physics,* Vol. 63, No. 8, pages 3388-3390 (Apr. 15, 1988). This latter work merely observed that the magnetic moment decreased by adding a transition element (TE) to a cobalt/boron or cobalt/copper alloy. The authors reasoned that the TE and boron or copper competed for hybridization of the cobalt state to result in such decrease.

Contrary to this MIT work, an investigation was undertaken in accordance with this invention to see if a stabilized cobalt-based transition metal alloy could be processed to result in significant enhancement of its magnetic properties while possessing high temperature stability and desirable corrosion resistance.

SUMMARY OF THE INVENTION

Greater microstructural crystallization and different microstructural proportioning of phases was found necessary to an enhancement of magnetic properties. This was brought about by reducing the cobalt content (to below 80%) to allow for the addition of a controlled combination of silicon and boron while utilizing a relatively high amount (14-20%) of a transition metal selected from the restricted group of Zr and Hf.

The invention is thus a new hard magnetic alloy free of by atomic percent rare earths, consisting of 14-20% of a transition metal having two unpaired electrons in the outermost d sublevel or orbital, 1-5% silicon, 0.3-5.6% boron, and the remainder essentially cobalt, the alloy having a microstructure substantially devoid of nonmagnetic phases and consisting of $(Co—Si)_{23}TM_6$ and $(Co—Si)_{11}TM_2$ magnetic phases, distributed throughout in a regular manner in a fine grain. The alloy may be represented by the formula: $Co_xTM_yB_{7-1.3z}Si_z$, where TM is a transition metal selected from the group consisting of zirconium and hafnium, x is 73-79; y is 16-20; and z is 1-5.

Preferably, substitution agents of nickel or iron may be used for up to 10% of the cobalt, substitutional agents of vanadium or niobium may be used for up to 5% of the TM, and substitutional agents of aluminum, copper, or gallium for up to 2% of the silicon. Preferably, the $(Co—Si)_{11}TM_2$ phase predominates in a volume ratio of 3:2 to 4:1 with respect to the $(Co—Si)_{23}TM_6$ phase. Preferably, the fine grain of the resulting alloy is in the range of 100-500 nanometers (i.e., 1000-5000 angstroms or 0.1-0.5 microns).

The alloy preferably exhibits magnetic properties comprising: $H_c$ of 4-8 KOe, two phases with one presenting a $T_c$ of about 600° C. and the other about 450° C., $M_s$ greater than 60 emu/gram, and $BH_m$ in bulk form of 17-30 MKOe. The alloy further exhibits high temperature stability of such magnetic properties characterized by little or no change in $H_c$ up to 450° C. and only partial reduction in $H_c$ up to 600°-800° C. The magnetic alloy exhibits enhanced corrosion resistance characterized by simulation of less than 300 mg/cm per year in sulphuric acid and less than 700 mg/cm per year in hydrochloric acid.

The invention is also the method of making a permanent magnet, comprising the steps of: (a) forming a solidified homogeneous alloy of, by atomic percent, 14-20% Zr or Hf, a combination of boron and silicon which totals 0.65-5.0%, and the remainder essentially cobalt, said forming being carried out in a nonoxidizing environment; and (b) control cooling said alloy during or subsequent to forming to experience the temperature range of 550°-700° C. for 5-60 minutes.

A specific method mode for making ribbons, comprises the steps of: (a) rapidly quenching by melt-spinning a homogeneous alloy of 14-20% transition metal selected from the group of zirconium and hafnium, 1-5% silicon, 0.3-5.6% boron, and the remainder essentially cobalt, the rapid quenching being carried out in an nonoxidizing environment to form a ribbon of hard magnetic alloy having a grain size of 0.1-0.5 microns; (b) heat treating said ribbon in a nonoxidizing environment in the temperature range of 550°-700° C. for 5-60 minutes; and (c) slow cooling the heat treated ribbon at about 1° C./minute resulting in an isotropic permanent magnet. Advantageously, the resulting ribbons from such method may be bonded together to form a bulk magnet shape or such ribbons may be ground and hot pressed to form a magnetically aligned bulk shape.

A specific method mode for making extruded bulk sized permanent magnets, comprises: (a) extruding a homogeneous solidified alloy consisting of 14-20% transition metal selected from zirconium and hafnium, a combination of boron and silicon according to the relationship $B_{0.3x}Si_x$ where x is in the range of 0.5–2 and the remainder essentially cobalt, said extrusion being carried out in a nonoxidizing environment with the alloy at a temperature in the range of 600°–800° C. to form a strand of desired cross-section and alloy microstructure; and (b) control cooling said extruded alloy to experience heat treatment in the range of 500°–700° C. for 5–60 minutes.

DETAILED DESCRIPTION AND BEST MODE

This invention enhances the magnetic properties of a cobalt-based/transition metal alloy. To this end, the chemistry of such alloy has been modified to obtain a new, more selective combination, as follows (in atomic percent):

1. Cobalt is restricted to the lower content range of 73–79%.
2. The transition metal is maintained at a high content range of 14–20%, but is restricted to such metals having two unpaired electrons in its outermost d sublevel or orbital, represented by zirconium and hafnium, and in that preferential order. Titanium may be used as the transition metal because it has similar properties to that of Zr and Hf, but due to its atomic size, it does not achieve comparable magnetic properties.
3. A controlled combination of silicon and boron is added, the silicon varying between 1–5% and boron between 0.3–5.6%. The combination is controlled according to the relationship $B_{7-1.3x}Si_x$, where x is 1–5.

Substitional agents of nickel or iron may be present for up to 10% of the cobalt; substitional agents of vanadium and niobium may be present for up to 5% of the transition metal; and substitutional agents of aluminum, copper or gallium may be present for up to 2% of the silicon.

The minimum content of cobalt is interrelated with the maximum content of the transition metal in that a reduction of one will lead to an increase of the other. If cobalt falls below 73%, thereby in most cases increasing the transition metal to above 20%, an undesired third phase will usually appear causing a degradation in the magnetic properties. The combination of silicon and boron preferably should not exceed 6.6% of the alloy, and, if such is experienced, there will be a progressive dilution of the magnetic moment. If the total content of silicon and boron is under 1%, the microstructure of the resulting alloy will be too amorphous, particularly in a rapidly quenched shape.

With the above chemistry, the alloy is more crystalline, maintains its magnetic properties even at temperatures up to at least 450° C, and higher in some other cases, and possesses greater corrosion resistance.

Figure 1:
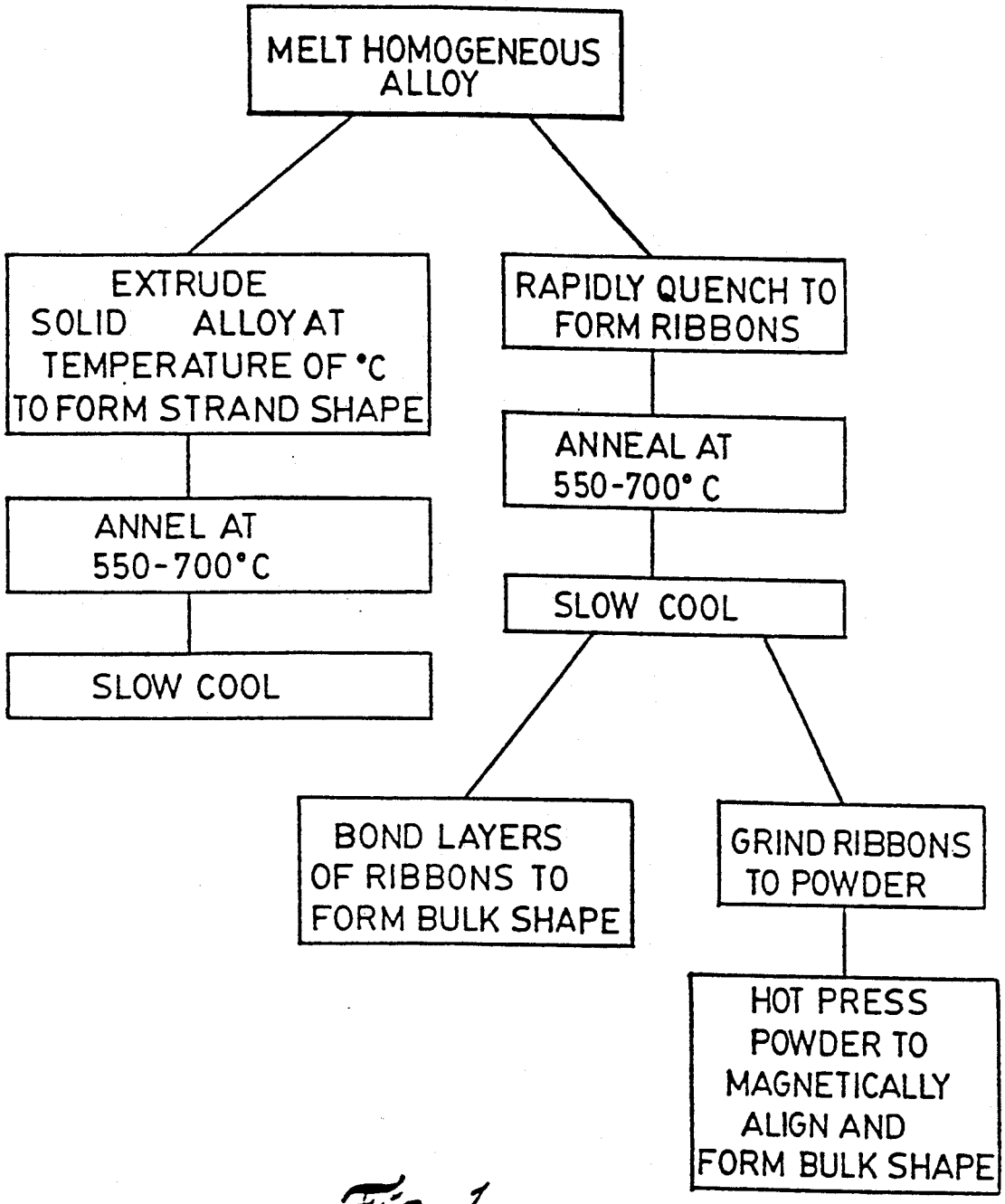
FIG. 1 is a flow diagram of the method aspect of this invention.

Processing plays an important role in the attainment of enhanced properties herein. As shown in FIG. 1, the molten alloy can be shaped into a magnetic material by (i) rapidly quenching into ribbons, which ribbons are either ground to particles and hot pressed to a bulk shape or bonded to form such bulk shape, or (ii) cast to shape preferably by extrusion at extrusion temperatures close to but below the $T_c$ temperature of the lower of the two phases of the alloy. The solidified shape should then be given an annealing heat treatment in the temperature range of 550°–700° C. for 5–60 minutes, followed by a slow cooling sequence such as 1° C./minute to assure crystallization.

When the shape is formed by rapid quenching, the following steps are preferred: (a) melt spinning of a homogeneous alloy of 16–20% transition metal selected from the group of Zr and Hf, $B_{7-1.3x}Si_x$, where x is 1–5, and the remainder being essentially cobalt, the melt spinning being carried out in a nonoxidizing environment to form a ribbon of hard magnetic alloy having a grain size of 0.1–0.5 microns; (b) heat treating such ribbon in a nonoxidizing environment in the temperature range of 550°–700° C. for 5–60 minutes; and (c) slow cooling such heat treated ribbon at about 1° C./minute resulting in an anisotropic magnet.

Preferably, the purity of the molten metal should be at least 99.9% pure, and the melting of the alloy by arc melting carried out several times to ensure homogeneity. The rapid quenching by melt-spinning is preferably carried out by use of a single copper wheel (see FIG. 2) rotating with a surface speed of about 450 rpm resulting in continuous ribbons typically 2 mm wide and about 200 microns in thickness. The ribbons can be sealed in quartz tubes under vacuum and heat treated, at temperatures in the range indicated for carrying out annealing, to optimize the magnetic properties.

Figure 3:
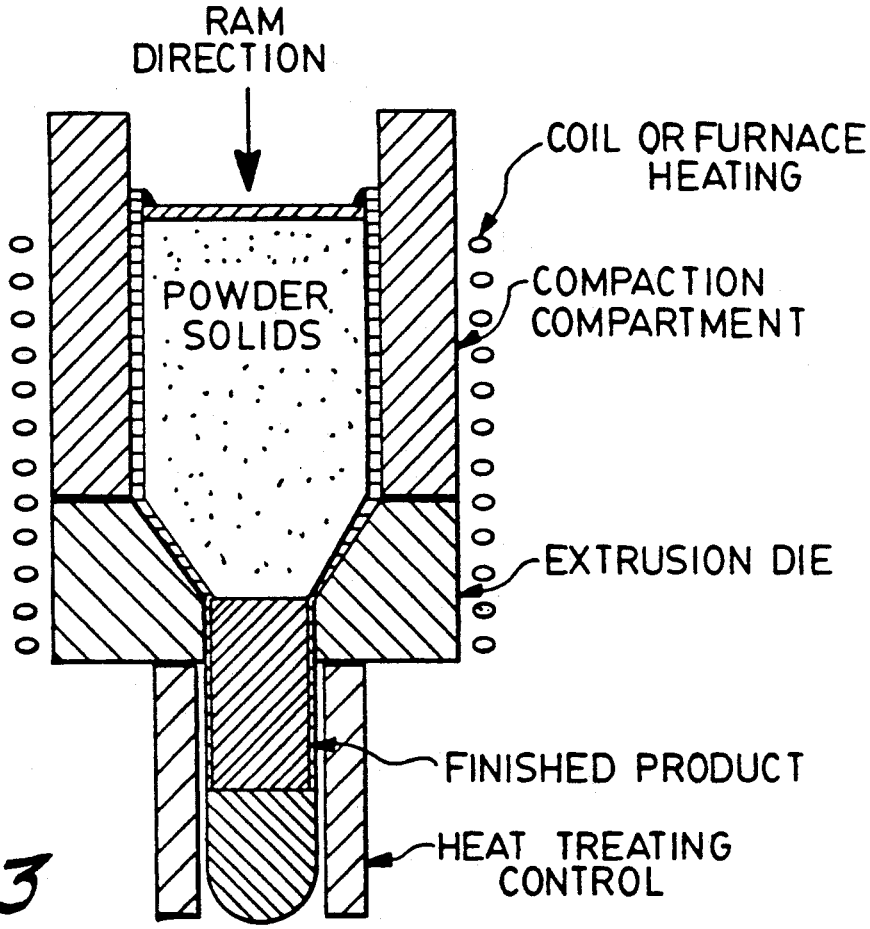
FIG. 3 is a schematic sketch of apparatus used to carry out extrusion.

To achieve the magnetic shape by extrusion, the method preferably comprises: (a) extruding (see FIG. 3) a homogeneous solidified alloy of 16–20% transition metal selected from the group of Zr and Hf, with the combination of $B_{0.3x}Si_x$, where x is 0.1–2, and the remainder being essentially boron, said extrusion being carried out in a nonoxidizing environment with the alloy at a temperature in the range of 600°–800° C. to form a strand of desired cross-section and desired alloy microstructure; and (b) control cooling the extruded alloy to experience heat treating in the range of 550°–700° C. for 5–60 minutes followed by slow cooling, such as about 1° C./minute, resulting in an anisotropic magnet shape.

Resulting Microstructure

The resulting microstructure will be comprised of two magnetic phases constituted of $(Co—Si)_{23}Zr_6$ which is hereinafter referred to as the 4:1 phase, and $(Co—Si)_{11}Zr_2$ which is hereinafter referred to as the 6:1 phase. The microstructure will have the 6:1 phase predominating, such phase having a $T_c$ temperature of higher than 600° C. The 4:1 phase will be in minor proportion having a $T_c$ temperature about 450° C. The 6:1 phase attracts silicon atoms more easily and therefore promotes the role of silicon to not only crystallize the microstructure but to promote a more uniform distribution and isolation of the magnetic phases. Accordingly, it is desirable to have a greater proportion of the 6:1 phase facilitating silicon to carry out such isolation.

Figure 4:
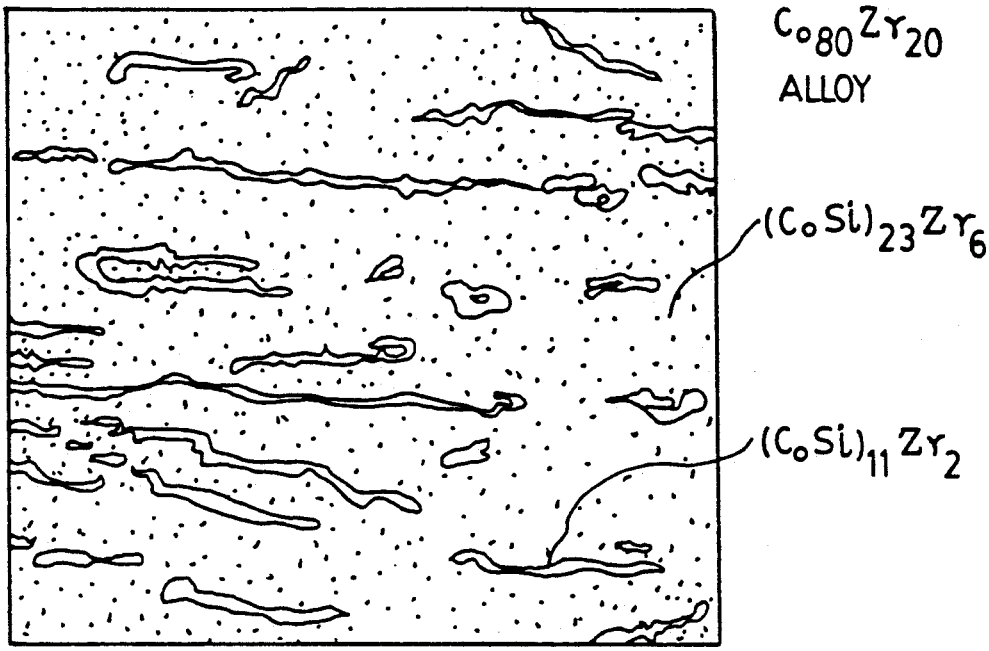
FIGS. 4 and 5 are illustrations corresponding to photographs made with a scanning electron microscope equipped with an EDXA to determine phases present, microstructure, and grain sizes.
Figure 5:
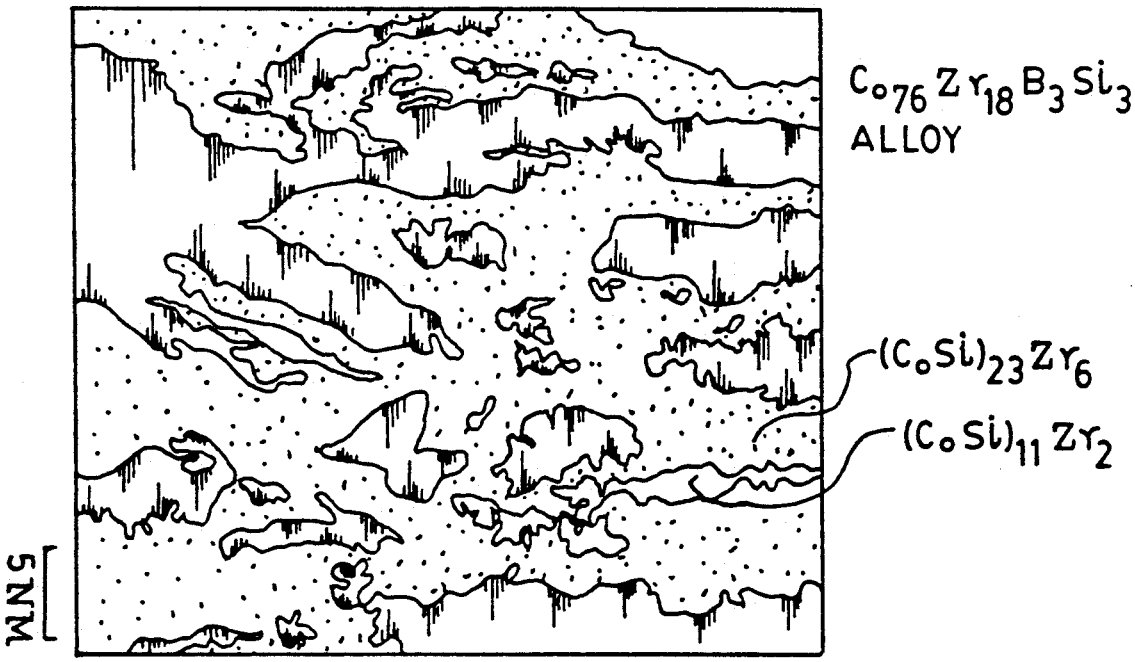
Figure 6:
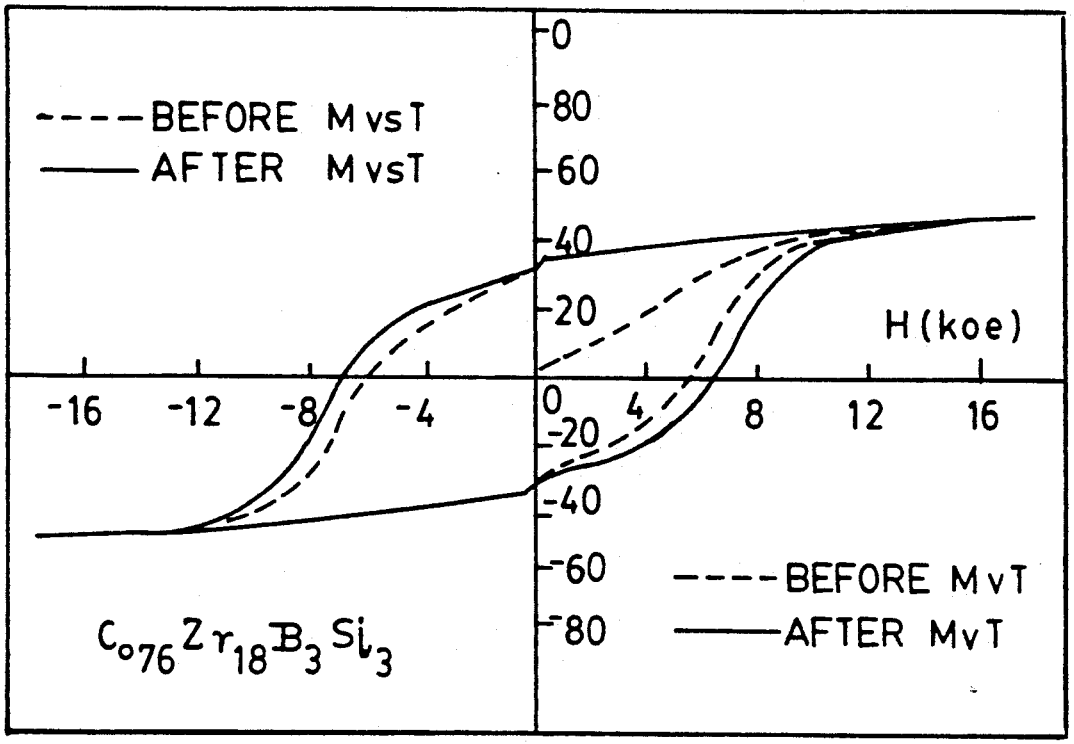
FIGS. 6 through 13 are graphical illustrations of magnetic hysteresis loops for various cobalt-based alloys as indicated in each figure, such loops being measured at ambient temperatures except for that indicated in FIG. 13.
Figure 7:
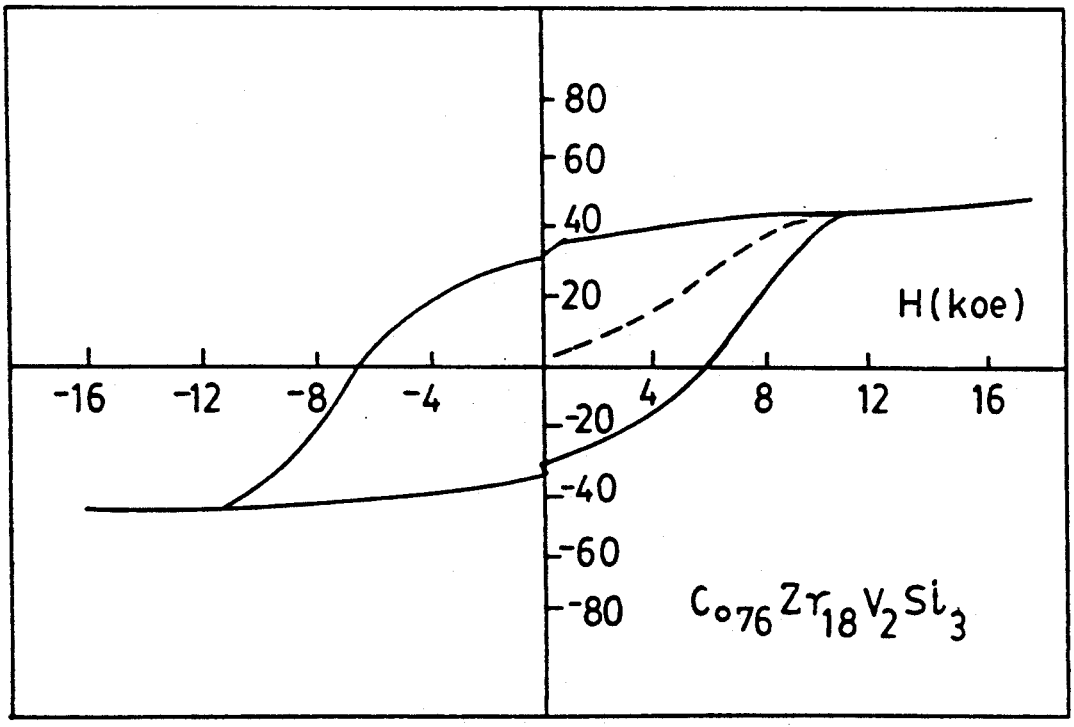
Figure 8:
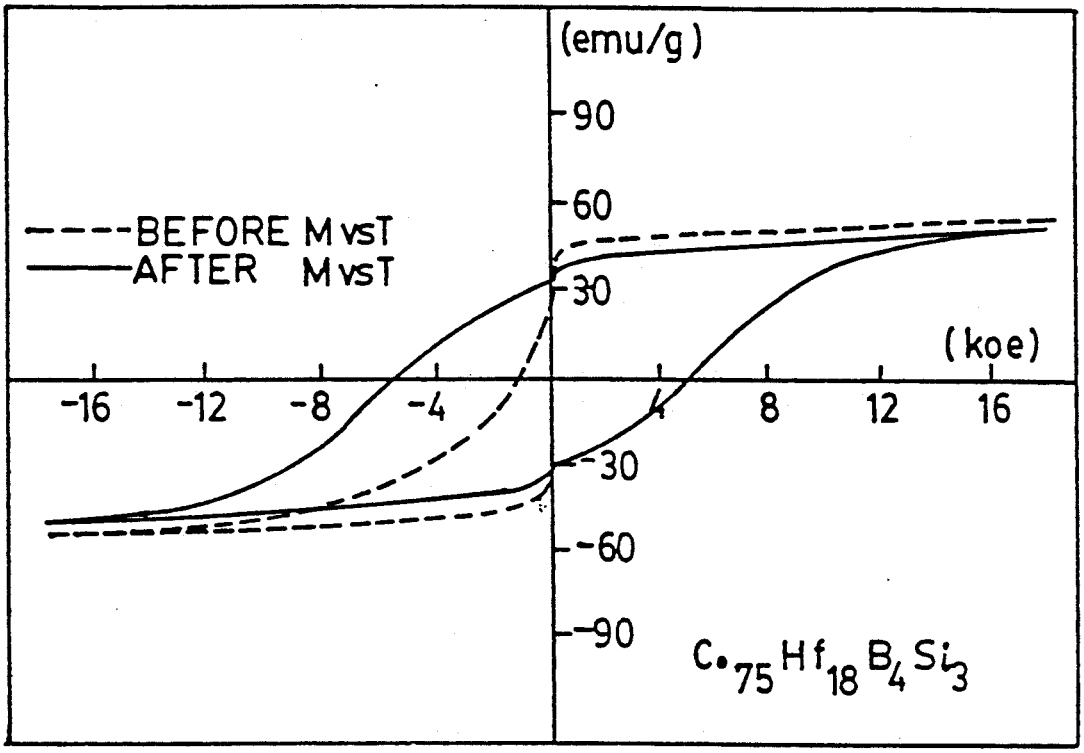
Figure 9:
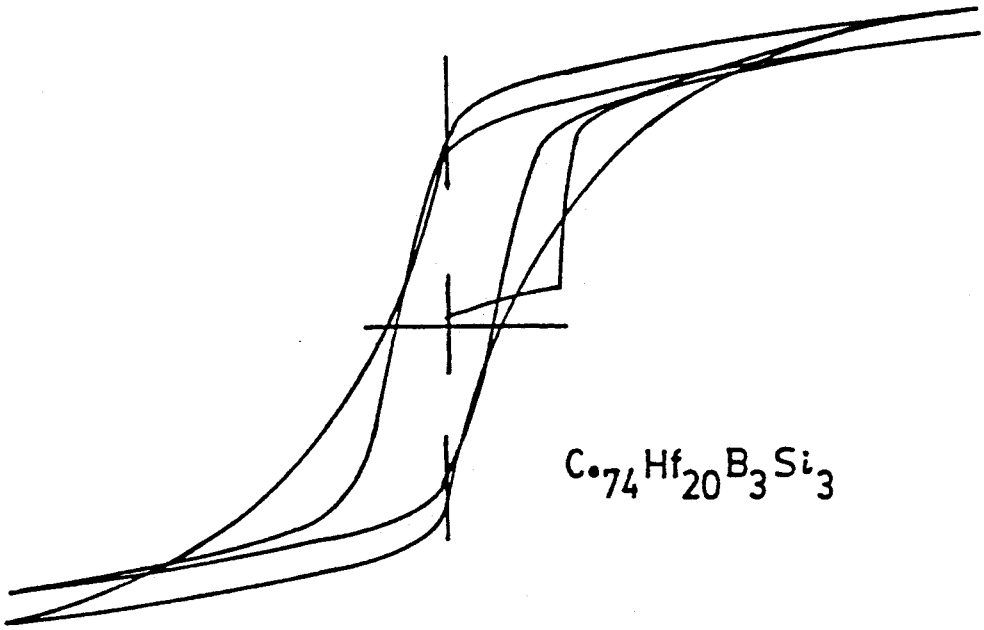
Figure 10:
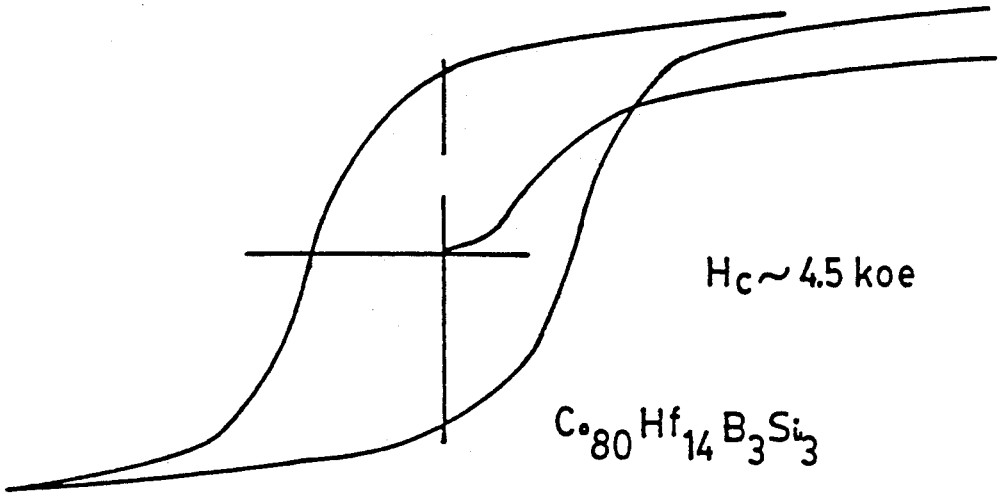
Figure 11:
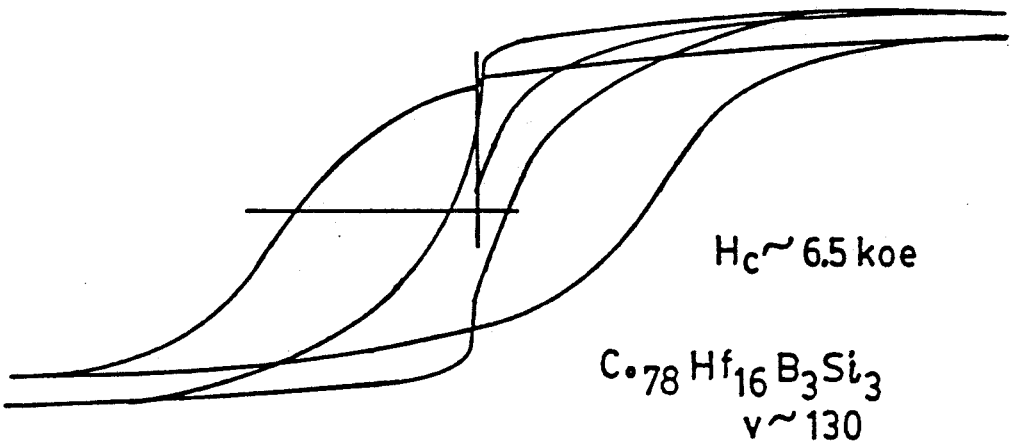
Figure 12:
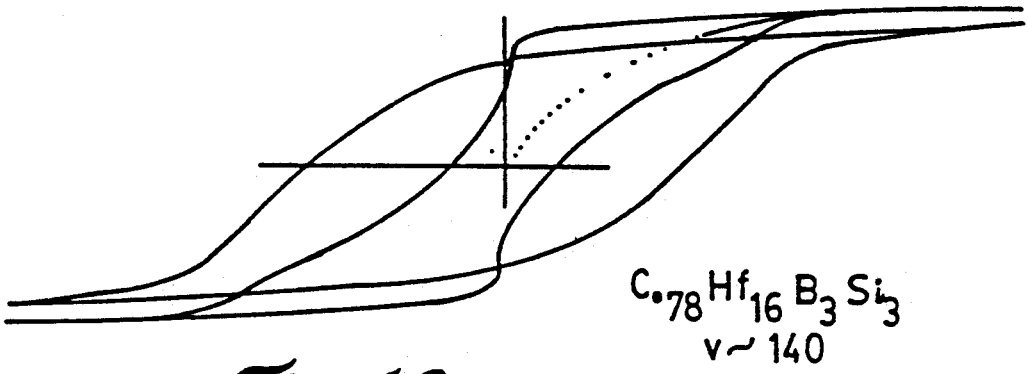

The proportioning of the two types of magnetic phases is shown by a comparison of FIGS. 4 and 5. The samples were polished and etched with a solution of 3% nitric acid in methanol and were then mounted on specimen holders with carbon paint. In FIG. 4, an alloy containing 80% cobalt and 20% zirconium was examined with a scanning electron microscope equipped with an EDXA to determine phases present and the grain sizes. The sample of FIG. 4 was composed of two phases, one bright and one dark, intertwined with each other in a dentritic structure. The bright phase contained 80.51% cobalt and 19.49% zirconium, which is the 4:1 phase, while the dark phase contained 85.93% cobalt and 14.08% zirconium, which represents the 6:1 phase. You will note that there is a predominance of the 4:1 phase by the existence of a greater proportion of bright phase. This alloy has poor coercivity and less than desired magnetic moment in bulk form.

In FIG. 5, the sample examined was of 76% cobalt, 18% zirconium, 3% silicon, and 3% boron. This sample had the same dentritic structure as the previous sample, but with a major difference. This example did not have the core area from which the dentrites of the other sample originated. The cobalt-rich phase (the dark phase) was the most abundant (being the 6:1 phase), and the bright phase (4:1 phase) was present only as dentrites, in a minor proportion. The size of the dentrites were about 3 microns wide and about 9 microns long. The composition of the bright phase was, on average, 74.76% cobalt, 22.23% zirconium, and 3.01% silicon, while the composition of the dark phase was 81% cobalt, 14.94% zirconium, and 4.06% silicon.

In addition to the unusual characteristic in the alloys of this invention having a higher preponderance of the 6:1 phase, there was an absence of a third phase, $ZrCo_2$ (a soft magnetic phase), which begins to appear in chemistries containing less than 73% cobalt. The presence of such third phase is detrimental to the magnetic properties of the shape because the $H_c$ will be considerably lower.

The intermetallic magnetic phases are isolated by the presence of nonmetallic silicon in the microstructure and are maintained in a relatively fine grain structure by the presence of such silicon. Fine grained is used herein to mean an absolute particle size range of 0.1–0.5 microns. The shaped magnet will have a coercivity $H_c$ in the range of 4–8 KOe, a magnetic saturation of greater than 60 emu/gram or 7–10.5 KOe (exhibited in bulk form), a Curie temperature greater than 400° C., and maintaining such properties in a high value up to 600° C. In order to confirm the enhanced thermal stability of the shaped magnet herein, the $Co_{76}Zr_{18}B_3Si_3$ alloy was heated to the temperature of 300° C. for 10 minutes and properties measured, and then heated to the level of 590° C. for 100 minutes and measured. The coercive force was measured after the first stage to be substantially the same as at ambient temperature with only slight variation; at 590° C., $H_c$ dropped off to 4.1. This shows that the alloy of the present invention is more magnetically stable than Fe/rare earth alloys. When an $Fe_{80}Nd_{12}B_8$ alloy is heated to 300° C. for 100 minutes, the coercive force drops substantially to zero.

The ribbon-formed samples of the alloys of the present invention were measured with respect to their corrosion resistance. This was carried out by immersing the samples in aqueous solutions of 1N—$H_2SO_4$, 1N—HCl, and 1N—NaCl, at 30° C. for one week to carry out the corrosion test. The obtained results are shown in Table I:

TABLE I

| | Corrosion Rate (mg/cm²/year) | | |
|---|---|---|---|
| | 1N—$H_2SO_4$ (30° C.) | 1N—HCl (30° C.) | 1N—NaCl (30° C.) |
| $Co_{76}Zr_{18}B_3Si_3$ | 27.2 | 36.5 | 0.0 |
| $Fe_{54}Co_{36}Zr_{10}$ | 1658.8 | 8480 | 10.1 |
| $Co_{80}Hf_{14}B_3Si_3$ | 23.0 | 30.1 | 0.0 |

EXAMPLES

Figure 2:
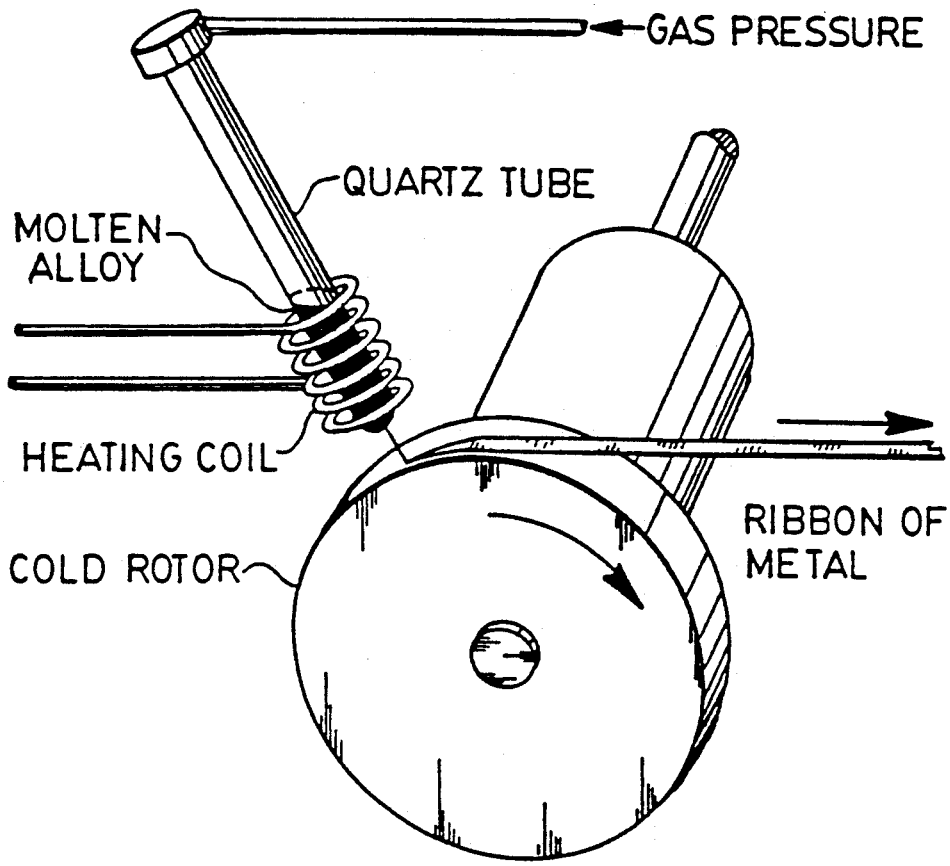
FIG. 2 is a schematic sketch of apparatus to carry out rapid quenching.

Alloys with the compositions as designated in Table II were prepared from raw materials by arc melting and were prepared using materials of 99.99% purity. The Table II samples were melted several times to ensure homogeneity. For ribbons, melt-spinning was used with a single rotating wheel at a speed of 4500 rpm. The apparatus for such melt-spinning is as shown in FIG. 2. The ribbons were sealed in quartz tubes under vacuum and heat treated at temperatures in the range of 550°–700° C. for 40 minutes. As the data in Table II shows, the samples having a chemistry within the ranges as disclosed for this invention exhibited a crystallization characterized by coercivities in the range of 4–8 KOe.

Hysteresis loops, as shown in FIGS. 6–13 for the individual alloys, identified in such figures, exhibits high coercivity when the chemistry of this invention is followed. It should be noted that FIGS. 10 and 11 differ not in the chemistry of the alloy, but rather in the velocity at which the ribbons were rapidly quenched, FIG. 10 having a wheel velocity of 130 and the results for FIG. 11 were at a wheel velocity of 140.

Figure 13:
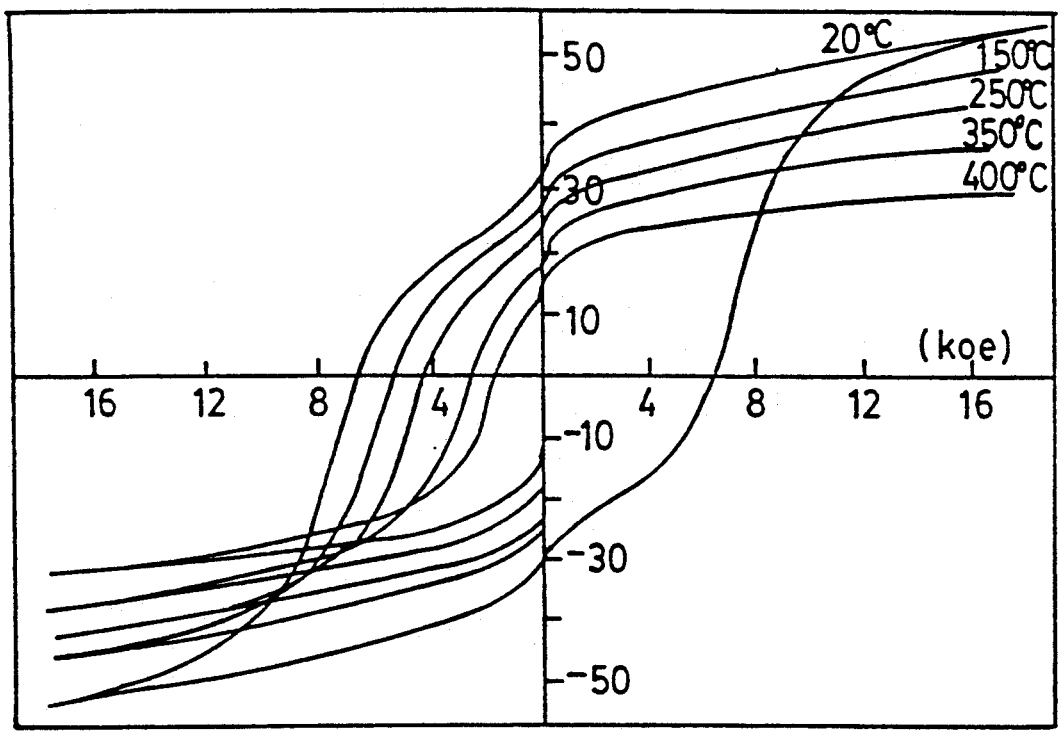
Figure 14:
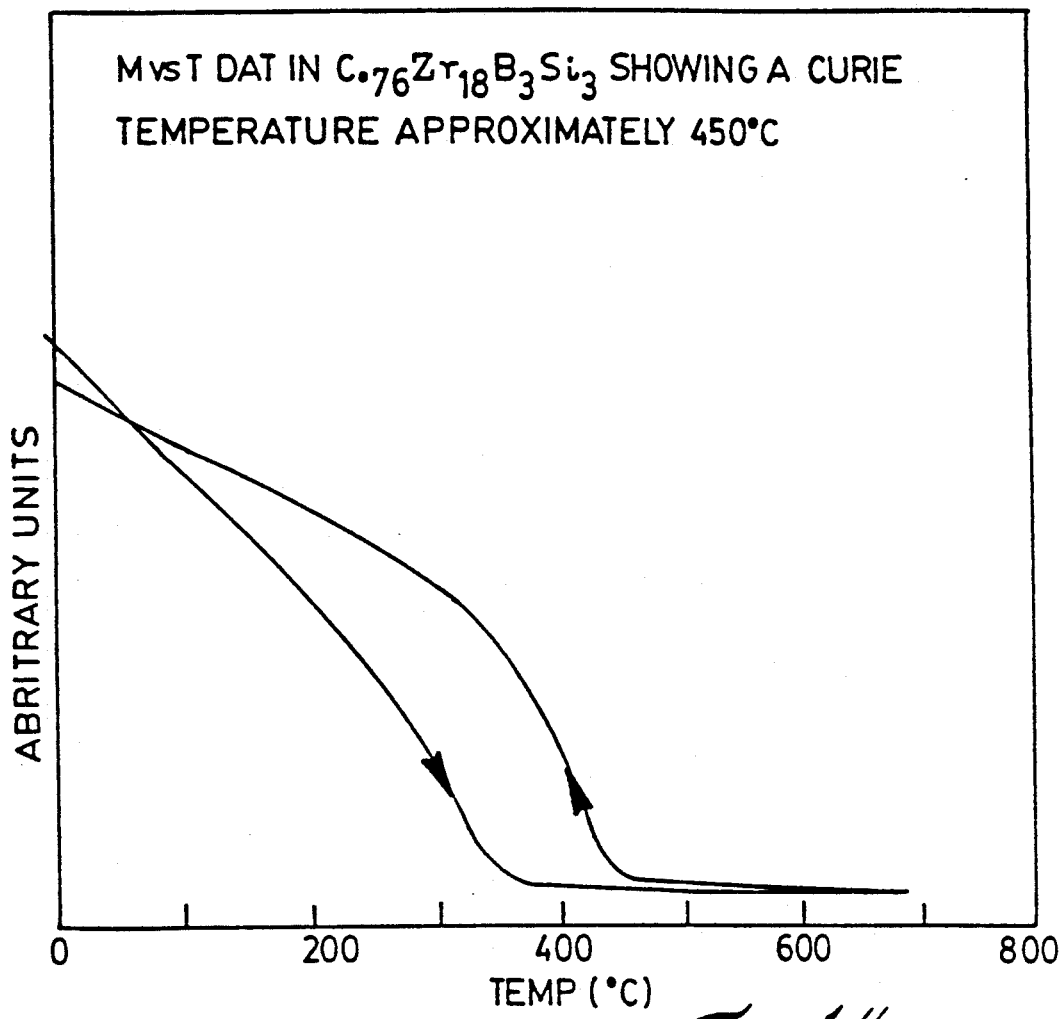
FIGS. 14 through 18 are graphical illustrations of M versus T data in designated cobalt-based alloys showing the Curie temperature thereof and existence of phases represented by temperature aberrations.
Figure 15:
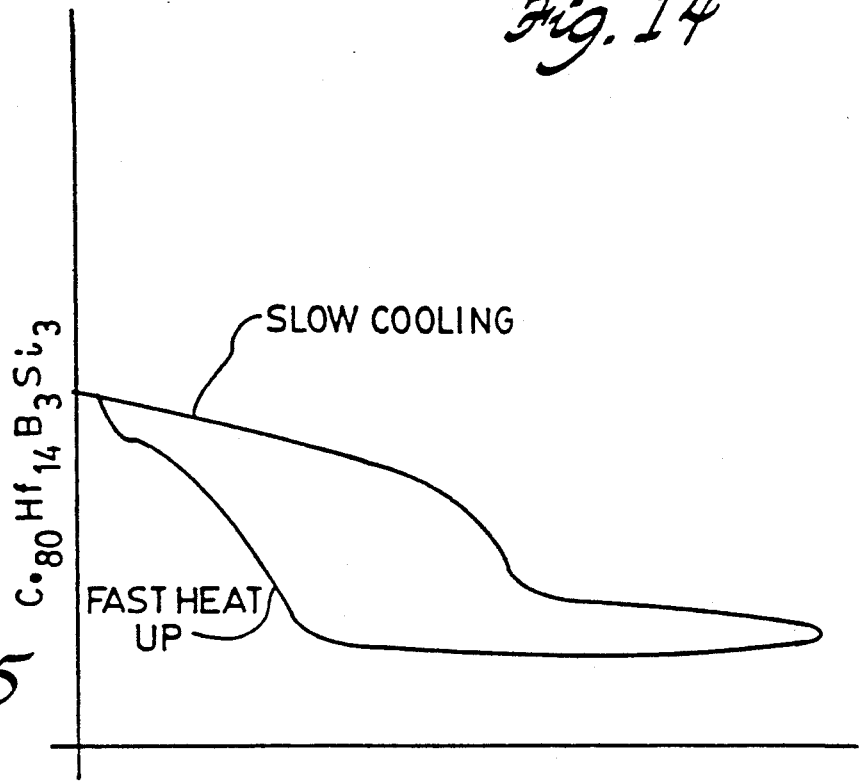
Figure 16:
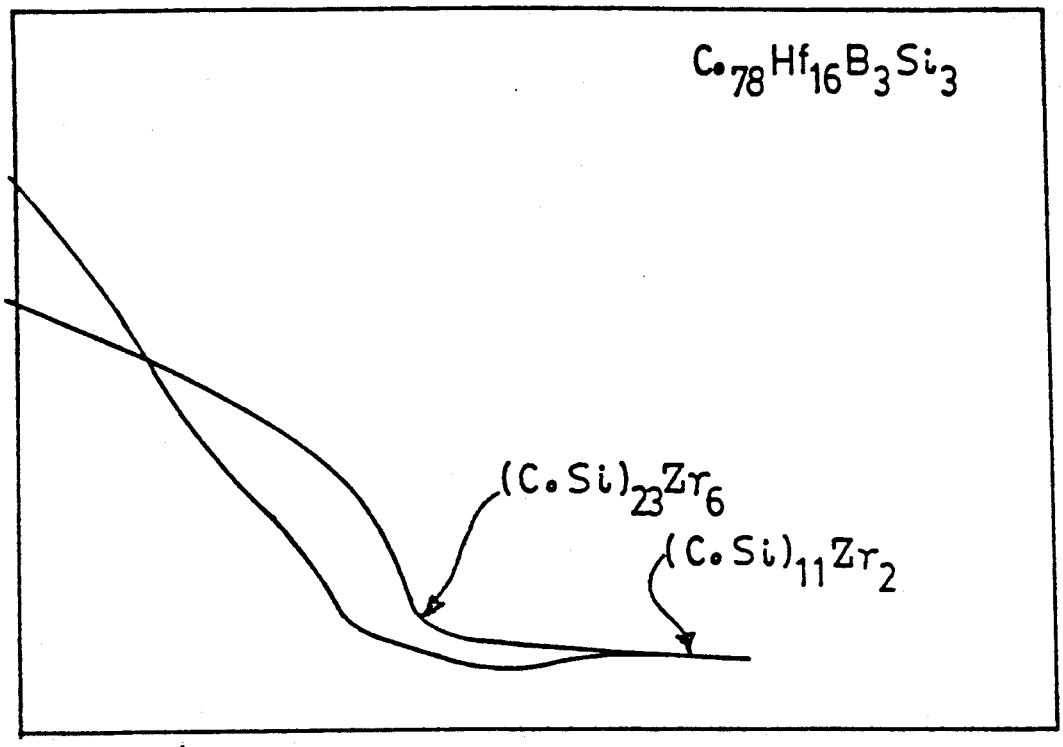
Figure 17:
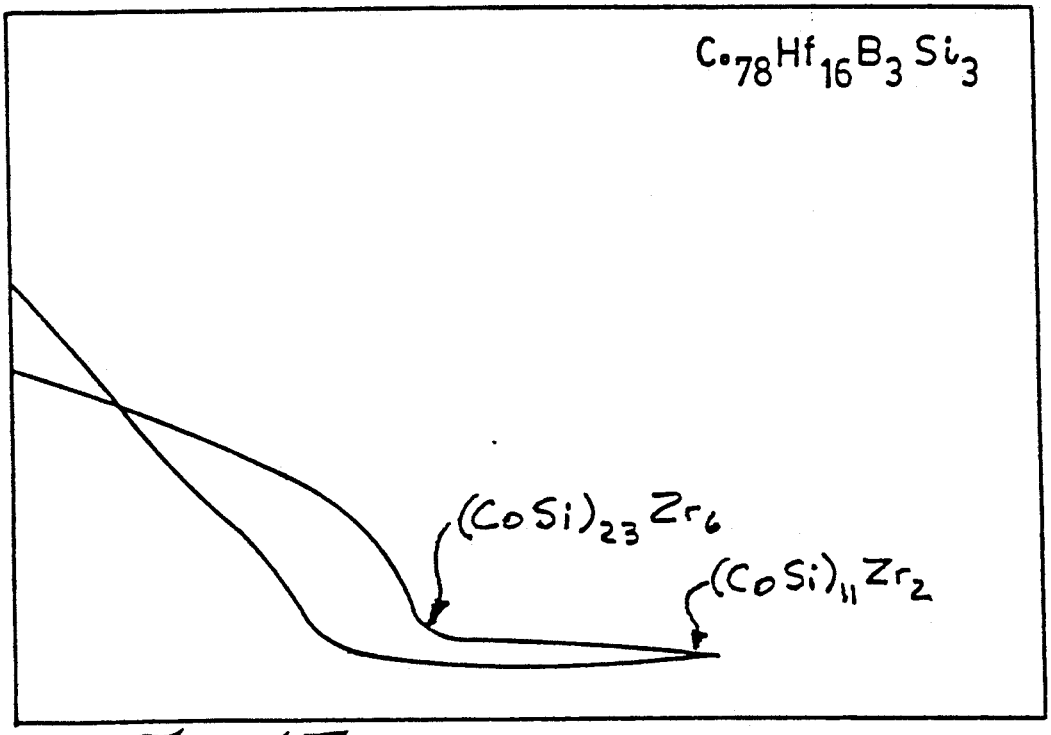
Figure 18:
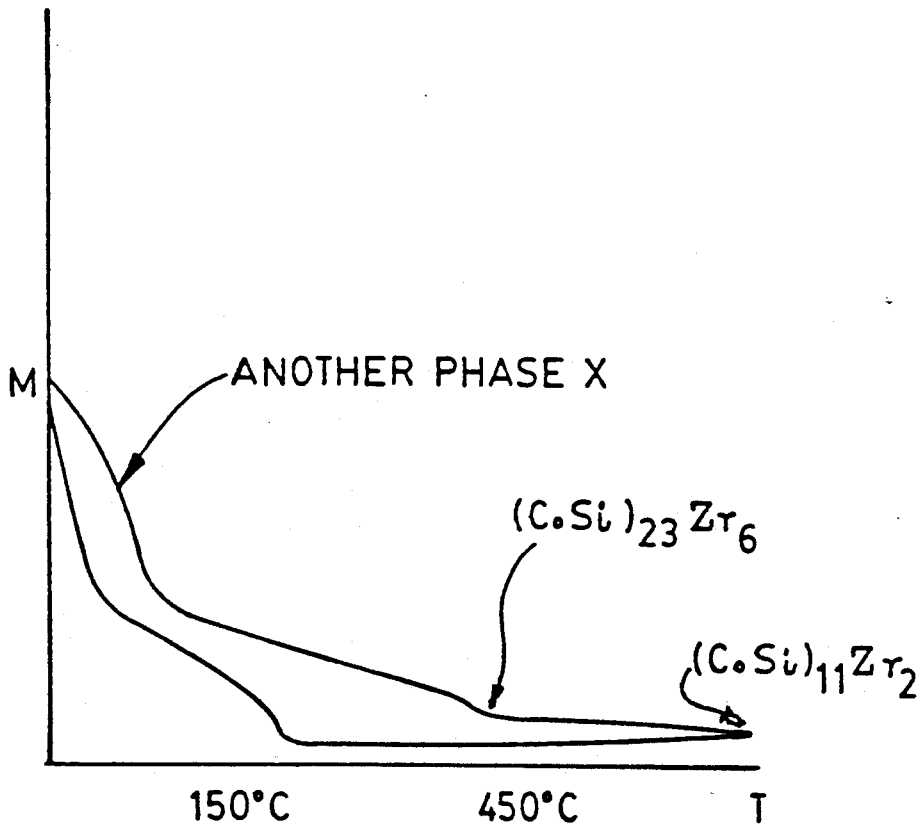

FIG. 13 demonstrates changes in the hysteresis loop, and thus $H_c$, as a function of test temperatures; the significance of this is very important. Note that at a temperature of 150° C., the alloy has an $H_c$ of about 5.5 KOe; such temperature is the maximum that will usually be experienced by a magnet in an automotive starter application.

FIGS. 14 through 18 represent M versus T data plotted for the specific alloys noted in such figures, wherein a variation in the cooling rate demonstrates the formation of different phases having their own a specific Curie temperatures at such phase change. This corroborates the existence of the desirable two phases when the chemistry is within that claimed herein.

Table III demonstrates the effects of varying certain process parameters, the most important being to hot extrude the alloy melt with the temperature range of 600°–800° C. It also was found useful to incorporate Cu in the alloy in an amount of 1–3% to facilitate extrusion. The extrusion technique or rapid quenching creates a fine grain microstructure that promotes magnetic properties without precipitation hardening. The ability to directly cast a high performance magnet by extrusion is of great significance. The need for silicon and boron is greatly reduced and cycle processing time is greatly reduced.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

TABLE II

| Alloy | $H_c$ in Ribbon Form (KOe) | $M_s$ in Bulk Form (emu/gram) | Presence of 2 Phases |
|---|---|---|---|
| $Co_{76}Zr_{18}B_3Si_3$ | 6.7 | 96 | yes |
| $Co_{77}Zr_{18}V_2Si_3$ | 5.7 | 64 | yes |
| $Co_{76}Zr_{18}V_3B_3$ | 3.9 | 67 | yes |
| $Co_{76}Zr_{16}V_2B_3Si_3$ | 6.1 | 86 | yes |
| $Co_{76}Zr_{14}Nb_4B_3Si_3$ | 4.0 | 74 | yes |
| $Co_{73}Zr_{20}B_4Si_3$ | 4.1 | 61 | yes |
| $Co_{78}Zr_{16}B_3Si_3$ | 6.2 | 89 | yes |
| $Co_{82}Zr_{12}B_3Si_3$ | 2.8 | 54 | no |
| $Co_{69}Zr_{25}B_3Si_3$ | 1.9 | 49 | 3rd phase |
| $Co_{76}Zr_{17.4}B_{5.6}Si_1$ | 6.4 | 92 | yes |
| $Co_{76}Zr_{18.7}B_3Si_5$ | 6.1 | 90 | yes |
| $Co_{74}Zr_{16}B_0Si_{10}$ | 4.8 | 51 | yes |
| $Co_{73}Zr_{20}B_7$ | 1.9 | 62 | yes |
| $Co_{76}Zr_{21}B_3$ | 2.3 | 48 | 3rd phase |
| $Co_{75}Zr_{18}B_5Cu_2$ | 3.9 | 60 | yes |
| $Co_{76}Zr_{16}B_6Ti_2$ | 3.6 | 45 | yes |
| $Co_{76}Zr_{16}B_6Mo_2$ | 3.5 | 52 | yes |
| $Co_{76}Zr_{17}B_5Ga_1$ | 4.2 | 62 | yes |
| $Co_{76}Zr_{16}B_6Nd_2$ | 2.6 | 38 | yes |
| $Co_{80}Zr_{16}B_4$ | 3.5 | 49 | no |
| $Co_{76}Zr_{16}B_8$ | 1.3 | 48 | yes |
| $Co_{74}Zr_{20}B_6$ | 3.3 | 52 | 3rd phase |
| $Co_{73}Ni_7Zr_{18}B_3Si_3$ | 5.3 | 59 | yes |
| $Co_{78}Hf_{16}B_3Si_3$ | 6.5 | 89 | yes |
| $Co_{76}Hf_{18}B_3Si_3$ | 5.2 | 70 | yes |
| $Co_{74}Hf_{20}B_3Si_3$ | 4.2 | 63 | yes |
| $Co_{75}Hf_{18}B_4Si_3$ | 4.1 | 54 | yes |
| $Co_{78}Zr_{16}B_6Nd_2$ | 2.6 | 47 | yes |
| $Co_{80}Zr_{16}B_4$ | 3.5 | 54 | no |
| $Co_{76}Zr_{16}B_8$ | 1.3 | 56 | yes |
| $Co_{74}Zr_{20}B_6$ | 3.3 | 49 | yes |
| $Co_{76}Hf_{18}B_3Ga_3$ | .9 | 62 | yes |
| $Co_{76}Hf_{18}B_3C_3$ | 1.8 | 39 | yes |

TABLE III

| | ($Co_{76}Zr_{18}B_3Si_3$) | | |
|---|---|---|---|
| | $H_c$ in Ribbons (KOe) | $H_c$ in Bulk Form (KOe) | $M_s$ in Bulk Form (KOe) |
| Rapidly Quenched Ribbons (Preferred Mode) | 6.7 | | 10 |
| Without Annealing | 1.6 | | 7 |
| Without Slow Cooling | 5.1 | | 8.4 |
| Ground Ribbons & Hot Pressed | 6.6 | | 9.5 |
| Extruded at Temp. 610° C. | | 7.6 | 9.8 |
| Extruded at Temp. 790° C. | | 6.3 | 9.1 |

APPENDIX

1. Greedan et al., "An Analysis of the Rare Earth contribution to The Magnetic Anisotropy in $RCo_5$ and $R_2Co_{17}$ Compounds", Journal of Solid State Chemistry, vol. 6, 1973, pp 387-395.
2. Leamy et al., "The Structure of Co—Cu—Fe—Ce Permanent Magnets", IEEE Transactions on Magnetics, vol. MAG—9, No. 3, September 1973, pp. 205-209.
3. Ray et al., "Easy Direction on Magnetization in Ternary $R_2$(Co,Fe) Phases", IEEE Transactions on Magnetics, September 1972, pp. 516-518.
4. Melton et al., "A Electron Microscope Study of Sm—Co—Cu—Based Magnetic Materials with the $Sm_2Co_{17}$ Structure", J. Appl. Phys., vol. 48, No. 6, June 1977, pp. 2608-2611.
5. Senno et al., "Magnetic Properties of Sm—Co—Fe—Cu Alloys for Permanent Magnetic Materials", Japan J. Appl. Phys., vol. 14, (1975), No. 10, pp. 1619-1620.
6. Nezu et al., "$Sm_2$(Co, Fe, Cu)$_{17}$ Permanent Magnet Alloys with Additive Element Hf", pp. 437-449. Mainichi Daily News, Saturday, June 4, 1983, "Strongest Magnet Unveiled".
7. Nagel et al., "Influence of Cu-Content on the Hard Magnetic Properties of Sm(co,Cu) 2:17 Compounds", IEEE Transactions on Magnetics, vol. MAG-14, No. 5, September 1978, pp. 671-673.
8. Ojima et al., "Magnetic Properties of a New Type of Rare-Earth Cobalt Magnets: $Sm_2$(CO, Cu, Fe, M)$_{17}$", IEEE Transactions on Magnetics, vol, MAG-13, No. 5, September 1977, pp. 1317-1319.
9. El Masry et al., "Phase Equilibria in the Co—Sm—B System", Journal of the Less-Common Metals, vol. 96, January 1984, pp. 165-170.

What is claimed:

1. A hard magnetic alloy free of rare earths, consisting of, by atomic percent:

14-20% of a transition metal having two unpaired electrons in the outermost d sublevel or orbital;

$B_{7-1.3x}Si_x$, with x being 1-5; and the remainder essentially cobalt, said alloy having a microstructure substantially devoid of nonmagnetic phases and consisting of $(Co—Si)_{23}TM_6$ and $(Co—Si)_{11}TM_2$ magnetic phases distributed throughout in a regular manner in a fine grain.

2. The magnetic alloy as in claim 1, in which the grain structure is sized in the range of 100-500 nm.

3. The magnetic alloy as in claim 1, which is characterized by the following magnetic properties: $H_c$ of 4-8 KOe, $T_c$ greater than 400° C., $M_s$ greater than 60 emu/gram, all at ambient temperature.

4. The magnetic alloy as in claim 3, having enhanced corrosion resistance, represented by the alloy experiencing less than 300 mg/cm$^2$ per year when immersed in a sulphuric acid and less than 700 mg/cm per year when immersed in a hydrochloric acid.

5. The magnetic alloy as in claim 1, in which said $(Co—Si)_{11}TM_2$ phase predominates in a volume ratio of 3:2 to 4:1 with reference to the $(Co—Si)_{23}TM_6$ phase.

6. The magnetic alloy as in claim 1, which has an $H_c$ of 4-8 KOe up to an elevated temperature of 450° C. and an $H_c$ of 3-6 KOe up to 600° C.

7. A hard magnetic alloy free of rare earths, consisting essentially of $Co_xTM_yB_{7-1.3z}Si_z$, where TM is a transition element selected from the group consisting of zirconium and hafnium, and x is 73-79, y is 16-20, and z is 1-5.

8. The magnetic alloy as in claim 7, having, by atomic percent, (i) substitutional agents of nickel or iron for up to 10% of the cobalt, (ii) substitutional agents of vanadium or niobium for up to 5% of TM, and (iii) substitutional agents of aluminum, copper, or gallium for up to 2% of the silicon.

9. A hard magnetic alloy consisting of, by atomic percent, 76% cobalt, 18% zirconium, 3% boron, and 3% silicon, and having a coercivity at room temperature of at least about 6.7 KOe.

10. A hard magnetic alloy free of rare earths consisting of, by atomic percent, 78% cobalt, 16% hafnium, 3% boron, and 3% silicon, characterized by a coercivity after having been annealed at a temperature of 650° C. for 30 minutes and slow cooled, said coercivity being at least about 6.5 KOe.

* * * * *